US006182969B1

(12) United States Patent
Green

(10) Patent No.: US 6,182,969 B1
(45) Date of Patent: Feb. 6, 2001

(54) METHOD OF PLAYING A BLACKJACK WAGERING GAME

(76) Inventor: John R. Green, 1442 S. Delware Pl., Tulsa, OK (US) 74101-4838

( * ) Notice: Under 35 U.S.C. 154(b), the term of this patent shall be extended for 0 days.

(21) Appl. No.: 09/264,832

(22) Filed: Mar. 8, 1999

Related U.S. Application Data

(60) Provisional application No. 60/077,622, filed on Mar. 10, 1998.

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS 4,651,997 * 3/1987 Wood ..... 273/274
5,364,105 * 11/1994 Jones ..... 273/292
5,529,309 * 6/1996 Bartlett ..... 273/292

* cited by examiner

*Primary Examiner*—Benjamin H. Layno
(74) *Attorney, Agent, or Firm*—Ian F. Burns

(57) ABSTRACT

A blackjack wagering game in which an order card is dealt to determine the order of play. If the order card is a predetermined card, the dealer's hand is played before each player's hand, thereby giving an advantage to the players. In the preferred embodiment, the order card is a card that is dealt face up in the dealer's hand and the predetermined card is the ace of spades. A side wager is also disclosed in which a deck of cards used in the game has a plurality of card types. The card types are given a relative ranking. A side wager card is dealt during the game. If the side wager card is between two cards in a player's hand, then the player will win the side wager. In the preferred embodiment, the side wager card is the same card as the order card.

24 Claims, 3 Drawing Sheets

METHOD OF PLAYING A BLACKJACK WAGERING GAME

CROSS REFERENCES TO RELATED APPLICATIONS

This application claims priority of U.S. provisional patent application 60/077,622 filed on Mar. 10, 1998.

BACKGROUND OF THE INVENTION

1. Field of Invention

The present invention relates to a modified blackjack wagering game.

2. Description of Related Art

Blackjack or twenty-one wagering games are well known in the art. A number of variations have been developed. Some examples of modified blackjack games can be found in U.S. Pat. No. 5,154,429 to LeVasseur, U.S. Pat. No. 5,257,810 to Schorr et al., U.S. Pat. No. 5,275,416 to Schorr et al., and U.S. Pat. No. 5,288,077 to Jones.

However, the games disclosed in these references fail to provide a means for altering the order in which the players' and the dealer's hands are played. In the traditional game of blackjack, each player's hand is played before the dealer's hand is played. It has been found that reversing this order of play has a number of positive effects. By playing the dealer's hand first, the players are given an advantage because they automatically win when the dealer busts and when the dealer does not bust, the players can see exactly what their hand value must be in order to win. This advantage increases the excitement and enjoyment experienced by players which encourages players to play the game more often and for a longer period of time.

However, it is also important not to provide this advantage too often. If the order of play is reversed too often, the average pay out of the game will be too great the operator of the game will not make a profit. What has long been needed is a means for reversing the order of play in blackjack in a way that does not do so too often.

SUMMARY OF INVENTION

The present invention comprises a method of playing a blackjack wagering game. The method comprises the steps of dealing two cards to form a player's hand, dealing two cards to form a dealer's hand, and dealing an order card. If the order card is a predefined card or a card in a predefined group of cards, the dealer's hand is played before the player's hand is played.

The present invention also comprises a method of playing blackjack with a side wager. The method comprises the steps of providing at lease one deck of playing cards, the deck having a plurality of different types of cards, assigning a relative ranking to the types of cards in the deck, dealing at least two cards to form a player hand, and dealing an order card. If the rank of the order card is between the ranks of the player's cards, the player is awarded a prize.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Table Layout

Figure 1:
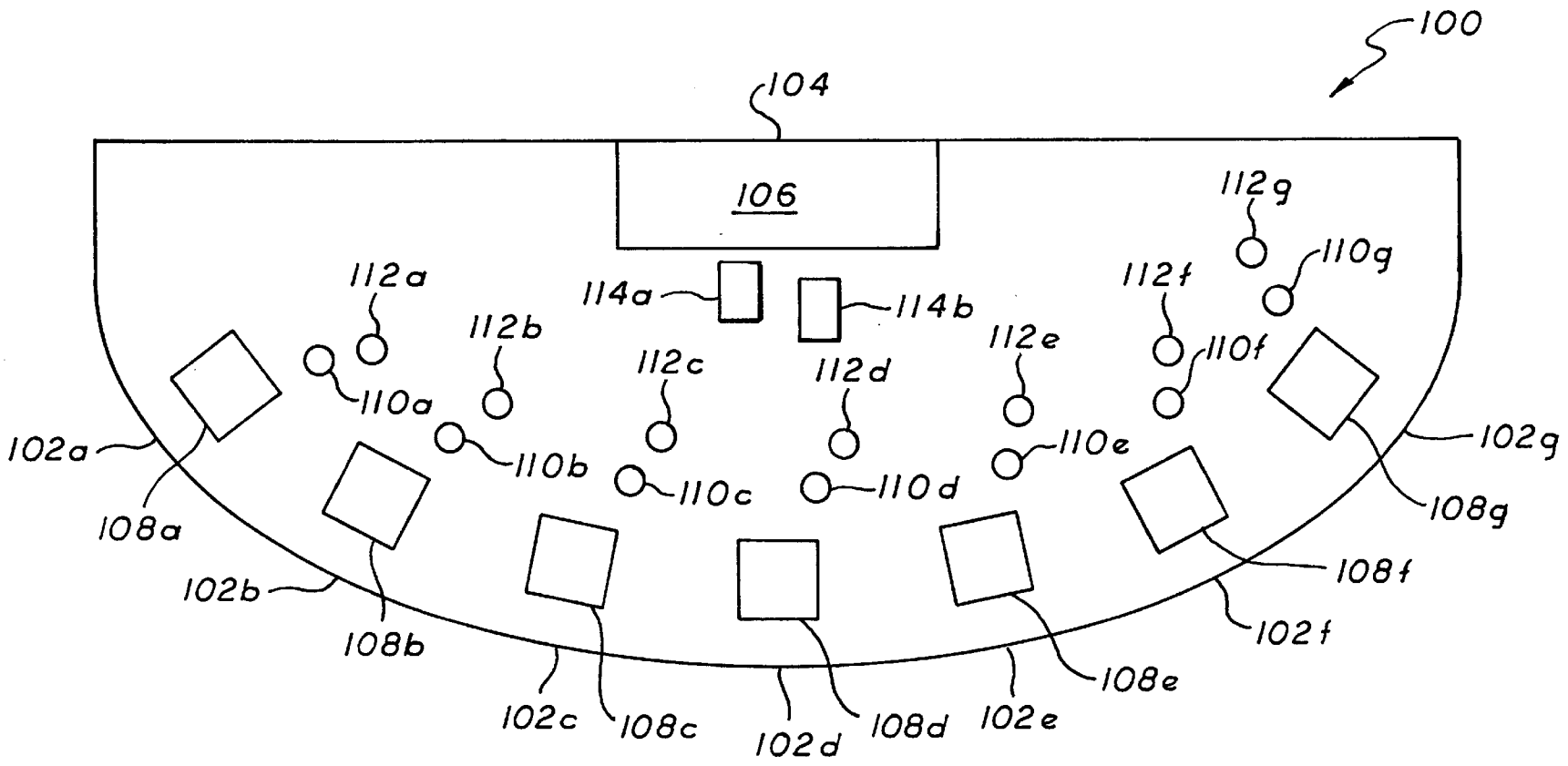
FIG. 1 is substantially a top schematic view of a table layout of one embodiment of the present invention.

The methods of the present invention may be implemented on a standard casino gaming table 100, an example of which is illustrated in FIG. 1. Table 100 has a playing surface which indicates a number of regions for cards and wagers. The playing surface is preferably colorful felt but many other surfaces may be used. In the preferred embodiment, seven player positions 102*a–g* are indicated on the playing surface near the curved edge of table 100. The playing surface may be designed to accommodate any number of players. However, seven players are generally the maximum number that can be efficiently managed by a single dealer.

A dealer station 104 is positioned on the flat edge of the table so that the dealer can face each of the players and observe their play. Dealer station 104 includes a chip area 106 that may be used to store chips, tokens, coins, or bills. Dealer card regions 114*a–b* may be provided for receiving the dealers cards.

The player positions 102*a–g* is provided with card areas 108*a–g* for receiving player cards when the game is dealt. The player positions 102*a–g* may also be provided with standard wager positions 110*a–g* and side wager positions 112*a–g*. Standard wager positions 110*a–g* are for receiving the standard wagers used in blackjack and the side wager positions 112*a–g* are for receiving wagers for the side wager of the present invention that will be described below.

At the beginning of each game, each player may place wagers in the form of chips, tokens, coins, or bills in wager positions 110*a–g* and 112*a–g*. The standard wager is resolved according to the rules of standard blackjack. Alternatively, no standard wager may be made and the wagers placed on side wager positions 112*a–g* may be the only wagers made by the players.

It is recognized that the present invention is not limited to play on table 100. Various layouts and playing surfaces may be used to carry out the present invention. In addition, the present invention is capable of being implemented on video gaming machines and computer terminals.

Order of Play

Figure 2:
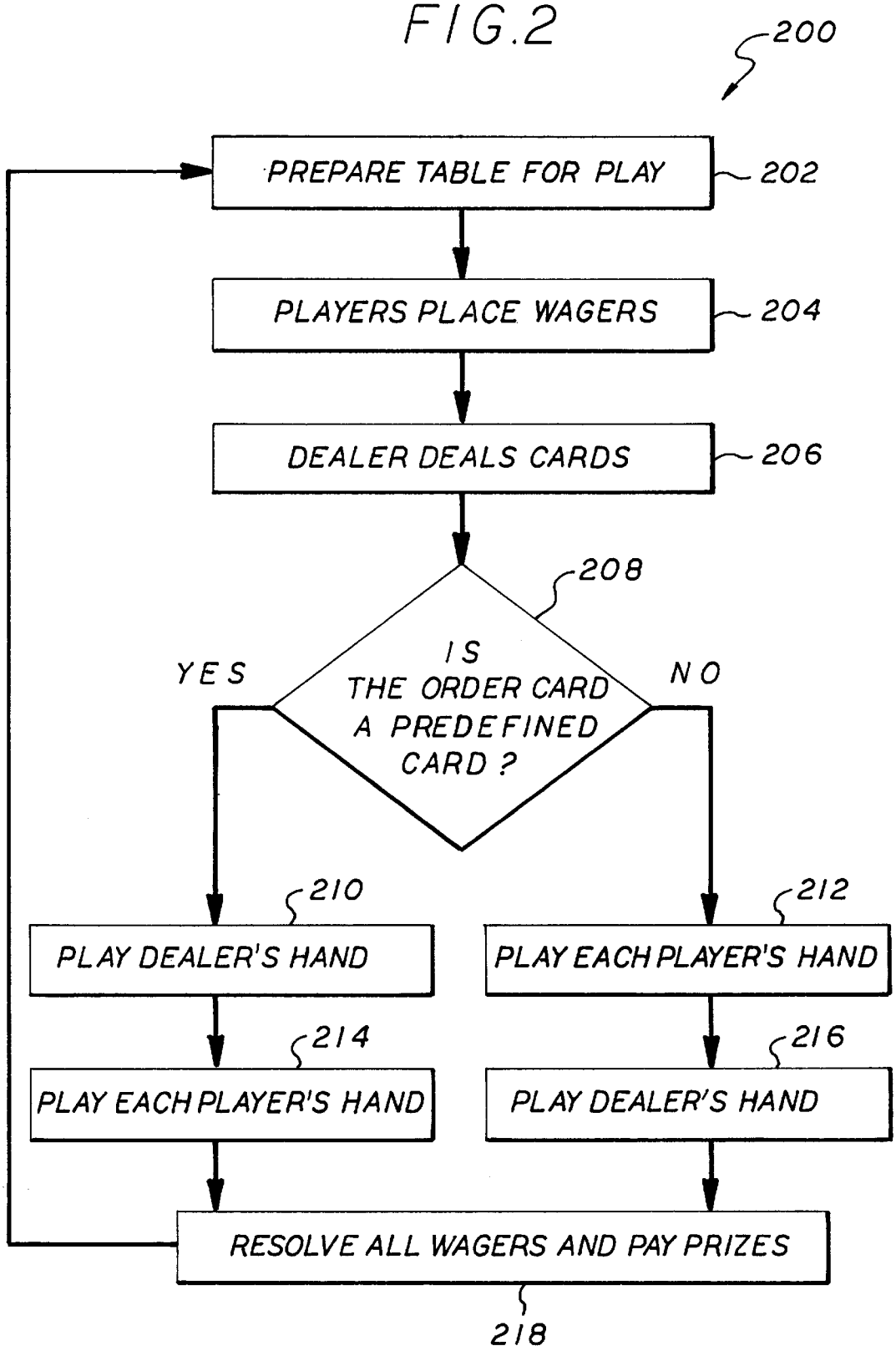
FIG. 2 is substantially a flow chart of the order of play portion of the present invention.

As seen in FIG. 2, the method of the order of play portion of the present invention, generally indicated by reference number 200, begins by preparing a table for play 202. This may include clearing the table of cards and shuffling a deck or decks of cards. The players then place their wagers 204 in accordance with the house rules (the rules of the operator of the game). The amount and type of the wagers may depend on the type of blackjack game played. For example, some modified blackjack games give players the option of placing proportional side wagers for different kinds of bonuses or prizes. The present invention may be used with most if not all of these modified blackjack games, and, as will be discussed below; the present invention comprises an optional side wager embodiment.

Once the players have placed their wagers 204, the dealer then deals the cards 206. In the traditional game of blackjack, two cards are dealt to each player to form the players' hands and two cards are dealt to the dealer to form the dealer's hand. In the present invention, at least one of the cards dealt to the dealer is dealt face up, which allows all of the players and the dealer to observe the card.

The present invention includes an order card. The order card is a card that is dealt to determine the order in which the dealer's and the players' hands are played. In the preferred embodiment, the order card is the card in the dealer's hand that is dealt face up. However, it is recognized that any dealt card could be the order card. The order card may be one of the cards in the players' hands or the order card may be a card that is dealt for the sole purpose of being the order card. In at least one modified game of blackjack, both of the dealer's cards are dealt face up. In this instance, the order card is preferably the first card dealt to the dealer. Alternatively, the order card may be a card that is dealt to a designated region, such as one of dealer card regions 114*a–b* in FIG. 1.

Before the beginning of each game, one card or a group of cards is defined as the designated card. If the order card is the designated card, the dealer's hand is played first. This designated card may be any card in the deck. In the preferred embodiment, for example, the designated card is the ace of spades. If the ace of spades is the designated card, the order of play will only be reversed on average once every fifty-two hands. This has been calculated to be an acceptable rate, which does not reduce the profitability of the game below an unacceptable level. Alternatively, the designated card may be a card that is not in a traditional deck of cards used to play blackjack. The designated card may, for example, be ajoker. For purposes of resolving blackjack hands, the joker may be a wild card or a card that has an assigned value. In addition, the designated card may be any card in a group of cards. For example, the designated card may be any ace or any spade.

After the dealer has dealt all of the hands 206, the method of the present invention asks if the order card is the designated card 208. If the order card is the designated card, the dealer's hand is played 210 before any of the players' hands are played 214. Playing a hand means either "hitting" of "standing." Hitting means adding cards to the hand while standing means leaving the hand as is without adding any further cards to the hand. After hitting, a hand may "bust" which means that the value of the hand exceeds twenty-one. If a hand busts, the hand is a losing hand. If a hand does not bust, the holder of the hand may hit again or stand. Whether the dealer hits or stands usually depends on the house rules. For example, the dealer may be required to hit when the dealer hand has a value lower than 17 and the dealer may be required to stand when the dealer hand has a value of 17 or more.

By playing the dealer's hand before the players' hands, the players are given an advantage. For example, if the dealer busts, the game is over and all of the players will automatically win no matter what the value of the their hand. If the dealer's hand is not a bust, the players' decision whether to hit or stand is made much easier. In this situation the players must either match the value of the dealer's hand to tie or exceed the value of the dealer's hand to win. Therefore, if a player sees that the player's hand is one or more lower than the dealer's hand, the player must hit in order to win the game. Of course, if the player busts, the player will loose the hand.

By providing the advantage to the players when the dealer's face up card is the ordered card, the present invention greatly increases the anticipation and excitement experienced by players. The player's perceive that they have a greater chance of winning and they tend to play the game more often for longer periods of time. This increases the income received by the game operator.

Returning to FIG. 2, if the order card is not the designated card 208, the game is completed in the traditional way with each player's hand being played 212 before the dealer's hand 216. All of the wagers are then resolved and any prizes are paid 218. At this point the game cycle may repeat and an indefinite number of games may be played.

Optional Side Wager

Figure 3:
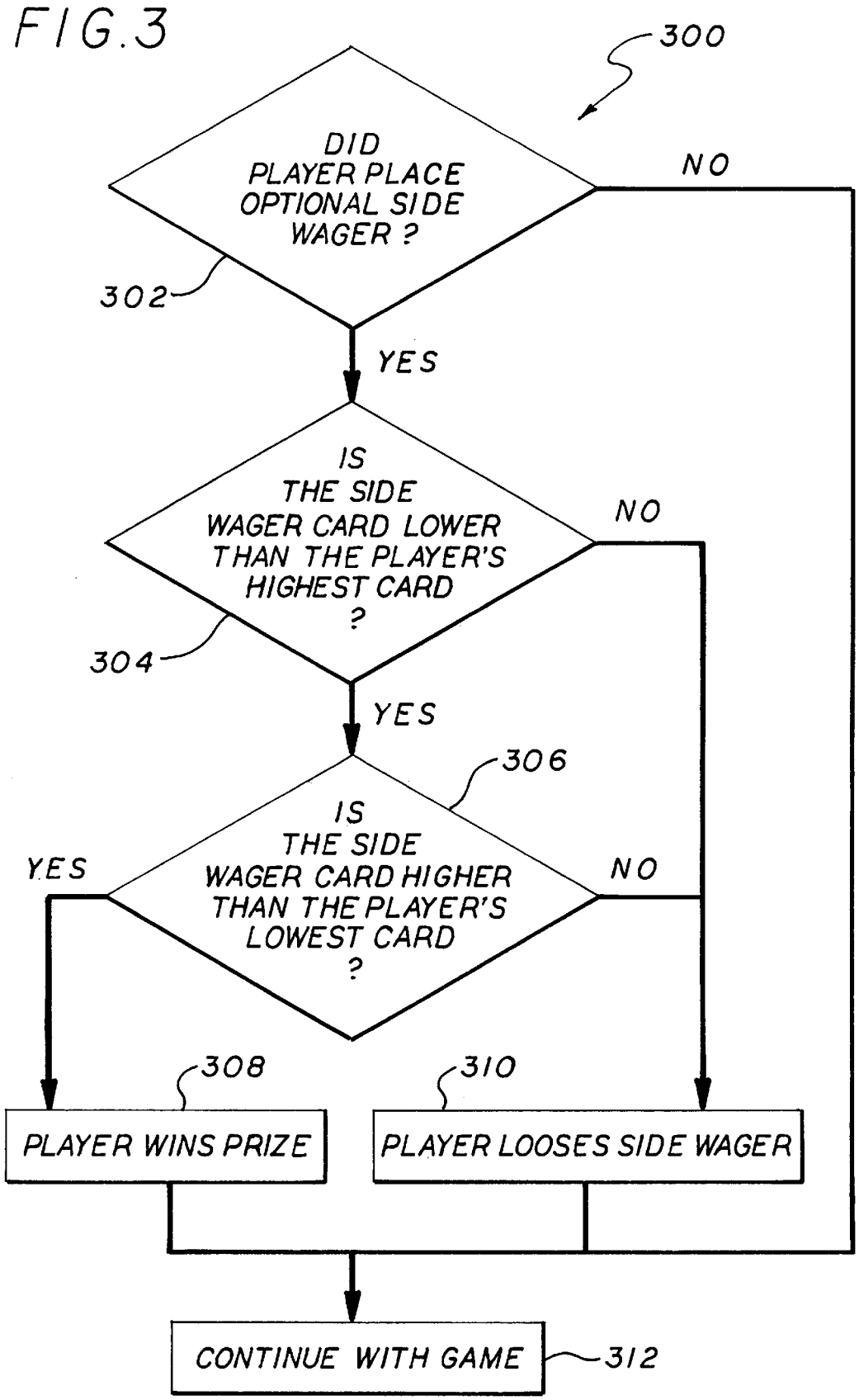
FIG. 3 is substantially a flow chart of the optional side wager portion of the present invention.

FIG. 3 represents the method of the optional side wager embodiment of the present invention, generally indicated by reference numeral 300. Method 300 is preferably incorporated into method 200, illustrated in FIG. 2 and discussed above. However, method 300 may be incorporated into the play of standard blackjack or other modified blackjack games.

If method 300 is incorporated into method 200, the step of allowing players to place wagers 204 is modified to allow the players to also place an optional side wager. The optional side wager may be placed on side wager positions 112*a–g* shown in FIG. 1.

Method 300 is preferably incorporated in the steps where each player's hand is played 214 and 212. Before a player's hand is played, the dealer determines whether the player placed the optional side wager 302. If the player did not place the optional side wager, the game would continue 312 and the player's hand would be played. If the player placed the optional side wager, the dealer resolves the side wager.

For purposes of resolving the side wager, each card in the deck is assigned a numerical ranking, preferably based upon standard poker ranking. Poker ranking is different than blackjack ranking in that the face cards, jack, queen, and king, have different relative ranks and aces are always highest. Therefore, the present invention assigns the following preferred numerical rankings:

| Card | Relative Numerical Rank |
|---|---|
| Two through Ten | The numerical face value of the card |
| Jack | Eleven |
| Queen | Twelve |
| King | Thirteen |
| Ace | Fourteen |

It is recognized that any of the cards could be assigned a different value for purposes of resolving the side wager. If the game is played with an additional card, such as a joker, the additional card may be assigned any value. In an alternative embodiment of the present invention, a joker is added to the standard deck of playing cards and it is assigned the value of ten and one half.

To resolve an optional side wager, the dealer determines whether a side wager card is between the player's cards. In the preferred embodiment, the side wager card is the same as the order card, used in the order of play portion of the invention. However, it is recognized that any dealt card may be used for this purpose. As in the order of play portion of the present invention, the order card is preferably a card dealt face up in the dealer's hand.

For the side wager card to be between a player's cards, the side wager card must be lower than the player's highest card 304 and higher than the player's lowest card 306. For example, if the side wager card is five and the player's cards are two and an ace, then the side wager card is between player's cards. If the side wager card is five and the player's cards are two and five, then the dealer's card is not between the player's cards. If the side wager card is five and the player's cards are both five, then the side wager card is not between the player's cards.

If the side wager card is not between the player's cards, then the player lose the side wager 310. However, if the side wager card is between the player's cards, then a side wager prize is awarded to the player 308. The side wager prize awarded to the player may be any type of prize, including a fixed prize or a prize that is proportional to the wager.

In one embodiment of the present invention, the side wager prize is paid in the proportion of two to one. For example, if the player placed a five-dollar wager and the player won, the player would be paid ten dollars. In addition, the side wager prize paid to the player may also increased if the side wager card and the player's cards are in the same suit. A standard deck of playing cards used in blackjack has four suits; clubs, diamonds, hearts, and spades. These suits can be used to define lower probability events that allow the game operator to give higher prizes. For example, if the side wager card is a club and the player's cards are both clubs, the player may be paid in the proportion of nine to one.

Referring back to FIG. 3, after the player wins or lose the side wager, the game would continue 312. This would preferably include playing the players hand. In an alternative embodiment, the players are allowed to play the optional side wager without playing the blackjack portion of the game.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A method of playing a blackjack wagering game, the method comprising the following steps:

(A) providing at least one standard deck of playing cards;

(B) dealing two cards to form a dealer's hand, one of the cards being dealt face up;

(C) dealing two cards to form a player's hand;

(D) playing the dealer's hand before playing the player's hand if the face up card in the dealer s hand is a predefined card or playing the player's hand before the dealer's hand if the face up card in the dealer's hand is not a predefined card.

2. The method of claim 1 wherein the deck of playing cards has a plurality of different types of cards, further comprising the following steps:

(A) assigning a rank to each type of card;

(B) awarding a prize to the player if the face up card in the dealer's hand is ranked between the cards in the player's hand.

3. A method of playing a blackjack wagering game, the method comprising the following steps:

(A) providing at least one deck of playing cards, the deck having at least four suits, each suit having thirteen cards of two through ten, Jack, Queen, King and Ace;

(B) assigning each of the two through ten cards their numerical face value rank of two through ten, respectively, assigning each of the Jack, Queen and King cards a numerical value of rank of ten, assigning each of the Ace cards a numerical value rank of one or eleven;

(C) dealing two cards from the deck of playing cards to form a player's hand;

(D) dealing two cards from the deck of playing cards to form a dealer's hand;

(E) dealing an order card from the deck of playing cards, wherein the order card may be observed to determine the order of play of the player's hand and dealer's hand; and (F) if the order card is a predefined card or a card in a predefined group of cards, playing the dealer's hand before playing the player's hand.

4. The method of claim 3 wherein the predefined card is an ace of spades.

5. The method of claim 3 wherein the order card is one of the cards dealt to form the dealer's hand.

6. The method of claim 3 wherein one of the cards dealt to the dealer is dealt face up and the order card is the face up card.

7. The method of claim 3 further comprising the following steps:

(A) dealing a side wager card;

(B) for purposes of comparing the side wager card to other cards, assigning a relative side wager ranking to each type of the card in the deck of cards; and (C) awarding a prize to the player if the side wager rank of the side wager card is between the side wager rank of the player's cards.

8. The method of claim 7 wherein the step of assigning a relative side wager ranking to each type of the card in the deck of cards comprises:

(A) assigning the two through ten cards a numerical ranking of their face value;

(B) assigning jacks a numerical ranking of eleven;

(C) assigning queens a numerical ranking of twelve;

(D) assigning kings a numerical ranking of thirteen; and (E) assigning aces a numerical ranking of fourteen.

9. The method of claim 7 further comprising the step of allowing the player to place an optional side wager wherein the step of awarding a prize to the player if the side wager rank of the side wager card is between the rank of the player's cards is only performed if the player placed the side wager.

10. The method of claim 7 wherein the prize awarded to the player is proportional to a value of the side wager.

11. The method of claim 7 wherein the prize awarded to the player has a fixed value.

12. The method of claim 7 wherein the prize awarded to the player is greater if the side wager card and the player's cards are the same suit.

13. The method of claim 7 wherein the side wager card is the same card as the order card.

14. The method of claim 7 further comprising the step of a player placing a wager to participate in the game.

15. The method of claim 14 further comprising the step of resolving the player's wager.

16. A method of playing a side wager game in conjunction with a blackjack game, the method comprising the following steps:

(A) providing at least one deck of playing cards, the deck having at least four suits, each suit having thirteen cards of two through ten, Jack, Queen, King and Ace;

(B) for purposes of playing the blackjack game, assigning each of the two through ten cards their numerical face value rank of two through ten, respectively, assigning each of the Jack, Queen and King cards a numerical value of rank of ten, assigning each of the Ace cards a numerical value rank of one or eleven;

(C) providing an opportunity for a player to place a side wager;

(D) dealing at least two cards from the deck of playing cards to form a player blackjack hand;

(E) dealing at least two cards from the deck of playing cards to form a dealer blackjack hand;

(F) dealing a side wager card;

(G) for purposes of comparing the side wager card to other cards, assigning a relative side wager ranking to each type of the card in the deck of cards;

(H) awarding a prize to the player if the side wager rank of the side wager card is between the side wager rank of the player's cards; and (I) resolving the player blackjack hand and the dealer blackjack hand.

17. The method of claim 16 wherein the step of assigning a relative side wager ranking to each type of the card in the deck of cards comprises assigning the following relative ranking in ascending order: two, three, four, five, six, seven, eight, nine, ten, jack, queen, king, and ace.

18. The method of claim 16 wherein the prize awarded to the player is proportional to a value of the side wager.

19. The method of claim 16 wherein the prize awarded to the player has a fixed value.

20. The method of claim 16 wherein the prize awarded to the player is greater if the side wager card and the player's cards are the same suit.

21. The method of claim 16 further comprising the followings steps:

(A) dealing an order card, wherein the order card may be observed to determine the order of play of the player's hand and dealer's hand; and (B) if the order card is a predefined card or a card in a predefined group of cards, playing the dealer's hand before playing the player's hand.

22. The method of claim 21 wherein the order card is the same card as the side wager card.

23. The method of claim 21 wherein the order card is one of the cards dealt to form the dealer's hand.

24. The method of claim 21 wherein the order card is dealt face up.

* * * * *